US006964064B1

(12) United States Patent
Yan

(10) Patent No.: US 6,964,064 B1
(45) Date of Patent: Nov. 15, 2005

(54) RUBBER PIPING ON CAP BILL EDGE

(76) Inventor: Suen Ching Yan, 17145 Margay Ave., Carson, CA (US) 90746

( * ) Notice: Subject to any disclaimer, the term of this patent is extended or adjusted under 35 U.S.C. 154(b) by 226 days.

(21) Appl. No.: 10/422,016

(22) Filed: Apr. 22, 2003

(51) Int. Cl.[7] ..... A42B 1/00
(52) U.S. Cl. ..... 2/175.2
(58) Field of Search ..... 2/10, 12, 425, 2/175.2–175.5; 40/329

(56) References Cited

U.S. PATENT DOCUMENTS

| | | | | |
|---|---|---|---|---|
| 1,706,856 | A | 4/1929 | Kleinberg | |
| 2,038,875 | A | 4/1936 | Siegelbaum | 2/178 |
| 2,088,930 | A | 8/1937 | Schwarz | 2/192 |
| D130,160 | S | 10/1941 | Simon | |
| 2,389,388 | A | 11/1945 | Schloss | 112/2 |
| 2,391,046 | A | 12/1945 | Tinnerman | 85/32 |
| 3,869,535 | A | 3/1975 | Coll-Palagos | 264/219 |
| 4,093,694 | A | 6/1978 | Browning | 264/246 |
| 4,606,077 | A | 8/1986 | Phillips | 2/12 |
| 4,914,755 | A * | 4/1990 | Motley | 434/399 |
| 4,964,171 | A | 10/1990 | Landis | 2/9 |
| 5,206,061 | A | 4/1993 | Ando et al. | 428/34.7 |
| 5,553,327 | A | 9/1996 | Koecher et al. | 2/200.3 |
| 5,701,607 | A | 12/1997 | Kaiser | 2/209.13 |
| 5,754,983 | A | 5/1998 | Landers | 2/195.1 |
| 5,765,229 | A | 6/1998 | McLeod et al. | 2/195.1 |
| D419,281 | S * | 1/2000 | Croft | D2/891 |
| 6,015,604 | A | 1/2000 | Stahl | 428/195 |
| 6,243,877 | B1 | 6/2001 | Heyward, Jr. | 2/195.1 |
| D452,767 | S | 1/2002 | Balloni et al. | D2/882 |
| 6,370,696 | B1 | 4/2002 | Kronenberger | 2/175.1 |
| 6,449,773 | B1 | 9/2002 | Shwartz et al. | 2/195.1 |
| 6,499,145 | B1 * | 12/2002 | Kates | 2/195.1 |
| 6,735,782 | B2 * | 5/2004 | Park | 2/175.5 |
| D492,094 | S * | 6/2004 | Park | D2/893 |
| 2002/0042941 | A1 * | 4/2002 | Grundy | 2/195.1 |

* cited by examiner

*Primary Examiner*—Katherine M. Moran
(74) *Attorney, Agent, or Firm*—Cislo & Thomas LLP

(57) ABSTRACT

Piping for the bill of a cap and a cap so disposed with piping. The piping is formed into the bill as by attachment to cloth covers or direct attachment to a stiffener. The piping may be made if plastic and may have a logo attached or formed therein as by embossment, engraving, or the like. The piping may enhance the grip upon the hat and may increase the attractiveness and/or appeal of such a hat.

21 Claims, 2 Drawing Sheets

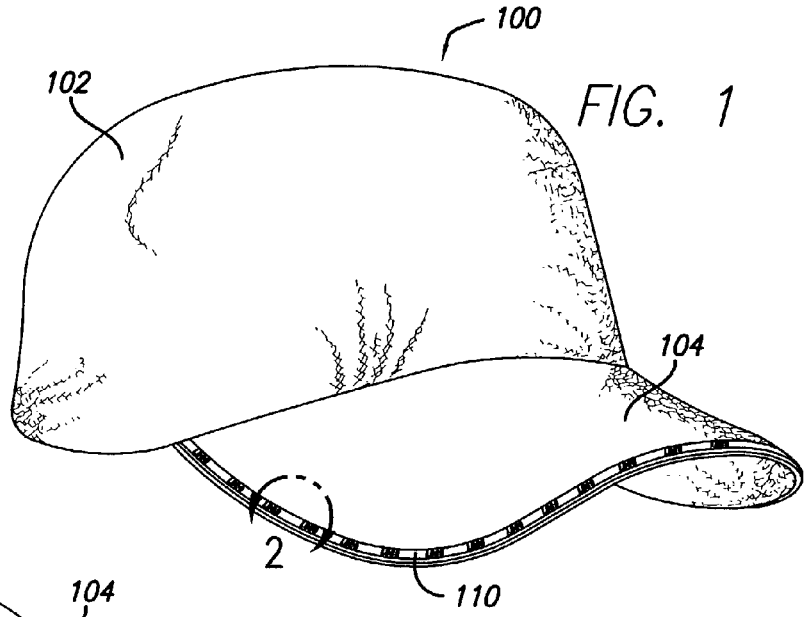
FIG. 1
FIG. 2
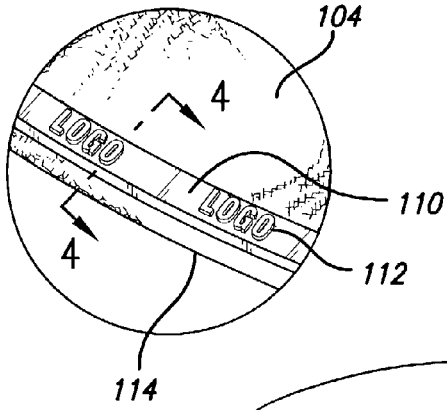
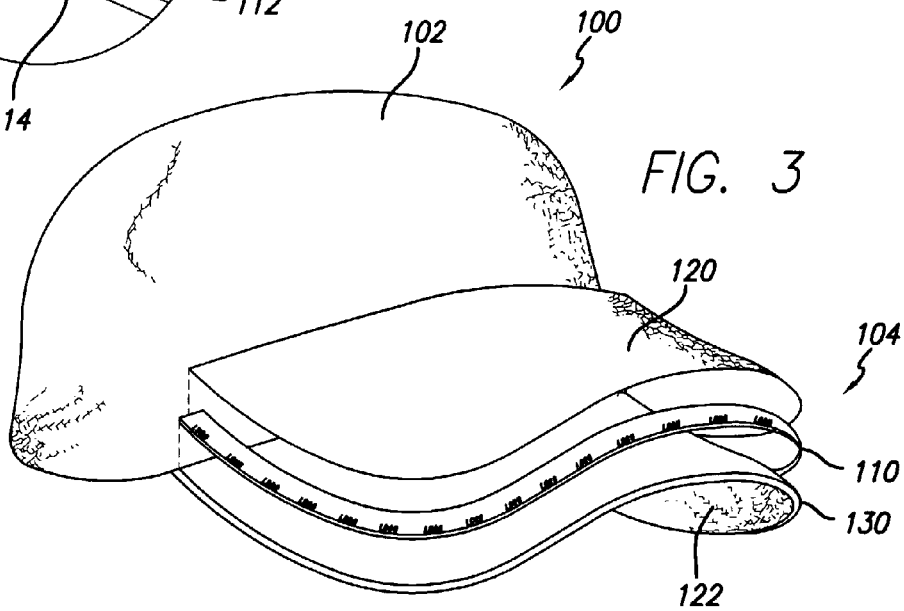
FIG. 3

RUBBER PIPING ON CAP BILL EDGE

COPYRIGHT AUTHORIZATION

Portions of the disclosure of this patent document may contain material which is subject to copyright and/or mask work protection. The copyright and/or mask work owner has no objection to the facsimile reproduction by anyone of the patent document or the patent disclosure, as it appears in the Patent and Trademark Office patent file or records, but otherwise reserves all copyright and/or mask work rights whatsoever.

BACKGROUND OF THE INVENTION

1. Field of the Invention

This invention relates to hats or caps, such as baseball caps, and more particularly to rubber, leather, or other piping that circumscribes at least a part of the perimeter of the bill for such cap.

2. Description of the Related Art

Caps, such as baseball caps, are well known in the art and are often used for recreational purposes. The bowl, crown, or body of the cap provides means by which the head may be covered in order to keep it protected from the sun and the attached bill, brim, or visor stands generally horizontally from the crown in order to provide a shade for the eyes. The baseball cap as a whole is generally made of cloth with optional stiffening material such as cardboard or plastic used to reinforce the bill. The cap may be made in a number of sections and may have a stretchable headband in order to provide elastic engagement for the head of the wearer.

The bill for such caps generally includes a piece of resilient material, such as cardboard or plastic, that is enclosed in cloth or other material to provide a more attractive and uniform appearance, among other things. The entire bill assembly may be stitched to the bowl with its sweatband or headband in order to provide an integrated baseball cap, hat, or other headgear having a bill.

Several attempts have been made previously to complement or augment the bill of a hat, such as a baseball cap. Listed below are several patents and/or publications relevant to the such previous attempts made to achieve such augmentation or decoration:

| | | | |
|---|---|---|---|
| 6,449,773 | 2002/0042941 A1 | 6,370,696 | Des. 452,767 |
| Des. 419,281 | 6,243,877 | 6,015,604 | 5,765,229 |
| 5,754,983, | 5,206,061 | 4,964,171 | 4,914,755 |
| 5,701,607 | 5,553,327 | 4,606,077 | 4,093,694 |
| 3,869,535 | 2,931,046 | 2,389,388 | Des. 130,160 |
| 2,038,875 | 2,088,930 | 1,709,856 | |

U.S. Pat. No. 1,709,856 discloses a hat and method of making, wherein the hat has a rubberized binding strip sewn to the outer edge of the brim as shown in FIG. 8 (element 20) and page 1, line 110 et seq.

U.S. Pat. No. 2,038,875 discloses a hat having a brim with a channel defined along the brims outer edge wherein a rubber tube is retained within the channel by a binding as shown in FIG. 4 (elements 14 and 16) and column 2, lines 25–46.

U.S. Patent No. 2002/0042941 discloses hat decorations that are designed to fit over the edge of a brim of the hat as shown in FIGS. 2 and 4.

U.S. Pat. No. 5,206,061 discloses a headgear having an opening with an edge containing an elastic material disposed along the edge, wherein the elastic material is a rubber string as shown in column 3, lines 3–7.

U.S. Pat. No. 2,391,046 discloses a reinforcement for a cap visor, wherein the reinforcement is a decorative stiffener trim mounted along the visor periphery as shown in column 1, lines 27–49.

U.S. Pat. No. 4,606,077 discloses a visor having a bead around the outer periphery of the bill as shown in column 3, lines 63–65.

U.S. Pat. No. 2,088,930 discloses a hat with a layer of vulcanized rubber on its brim as shown in column 1, line 24 et seq.

U.S. Pat. No. 2,389,388 discloses a device and method for stitching hat brims.

U.S. Pat. No. 3,869,535 discloses a method of embossing synthetic material using rollers.

Several patents disclose headwear having bills or visors made of rubber, including: U.S. Pat. No. 5,754,983, U.S. Pat. No. 5,765,229 (column 2, lines 20–27 and column 5, line 59 et seq.), and U.S. Pat. No. 4,964,171 (column 2, lines 42–44).

Some patents disclose headwear having indicia on the bill, including: U.S. Pat. Nos. 6,243,877, 4,914,755, 5,701, 607, 6,370,696, 6,449,773, and 5,553,327.

Some patents disclose a method for embossing indicia onto rubber, including: U.S. Pat. No. 4,093,694 (abstract) and U.S. Pat. No. 6,015,604 (column 4, lines 17–28).

Also, attempts have been made in the art to provide ornamentation for caps and hats as reflected by U.S. Design Pat. Nos.: Des. 419,281, Des. 452,767, and Des. 130,160.

Baseball caps and the like are often used for convenience and often indicate some disposition, mood, or opinion of the wearer. To this extent, baseball caps are decorated with indicia, logos, and the like. This is particularly true with baseball caps for baseball teams and also include corporate hats that may have corporate logos on them.

Consequently, there is a significant interest in means by which hats or caps can be decorated in an attractive and interesting manner. It would be an advance in the art to provide new means by which such decorations could be achieved in order to provide baseball hats or other hats with bills that are more attractive, more desirable, and fun to wear.

SUMMARY OF THE INVENTION

In view of the foregoing disadvantages inherent in the known types of hats and hat bill decorations now present in the prior art, the present invention provides a new baseball cap having piping circumscribing its bill wherein such piping can include logos, indicia, or the like and provide an attractive decoration for the bill of the cap.

The general purpose of the present invention, which will be described subsequently in greater detail, is to provide piping for the bill of a baseball cap which has many advantages of previous baseball cap bills and decorations therefor, and many normal features that result in a new and attractive decoration for baseball caps as well as a useful grip-enhancing device which is not anticipated, rendered obvious, suggested, taught, or even implied in the prior art baseball caps or hats, either alone or in any combination thereof.

Piping in the form of leather, rubber, or other material is coupled or attached to the bill of the cap by means of adhesion, stitching, the use of cloth covers, or the like. The piping can be adhesively or stitchedly attached to the stiffener used to stiffen the bill of the cap. The piping itself generally has a flat base that extends rearwardly from a forward projection that projects upwardly from the base. The piping can be made of plastic, leather, or other materials. The piping can also be attached to the cloth cover that enshrouds the bill stiffener in a manner where the piping circumscribes the upper or outer perimeter of the bill. Stitching may also be used to attach the piping to the bill.

The piping may be manufactured by providing a rubber, elastic, or flexible material. In addition, indicia deposited upon the face of the piping may be in melted rubber form and deposited on to the rubber or other strip comprising the base of the piping. After deposition of the melted material or otherwise, such indicia material is immediately cooled with cooling gas or otherwise and thereafter formed onto or into the bill edge in order to provide the piping set forth herein.

OBJECTS OF THE INVENTION

It is an object of the present invention to provide decoration for hats, baseball caps, and the like.

It is another object of the present invention to provide circumscribing piping for the bill of a baseball cap.

It is yet another object of the present invention to provide decorative piping for the bill of a baseball cap, such piping including indicia, logos, lettering, or the like.

These and other objects and advantages of the present invention will be apparent from a review of the following specification and accompanying drawings. The foregoing objects are some of but a few of the goals attained by the present invention.

BRIEF DESCRIPTION OF THE DRAWINGS

FIG. 1 is a right side front perspective view of a baseball cap having the piping circumscribing the bill as set forth herein.

FIG. 2 is an enlarged portion of a part of the piping shown in FIG. 1 along circle 2.

FIG. 3 is a right front perspective view of the baseball cap shown in FIG. 1 with the piping, the bill portion of the baseball cap being shown in exploded view.

DESCRIPTION OF THE PREFERRED EMBODIMENT(S)

Figure 4:
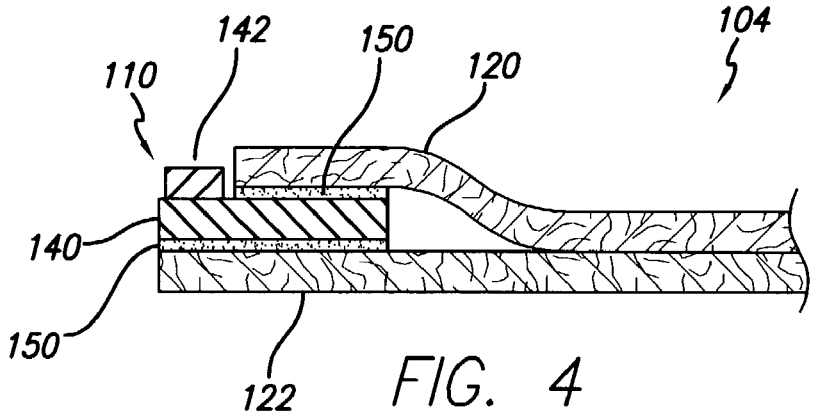
FIG. 4 is a cross sectional view taken along line 4—4 of FIG. 2.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Referring to the drawings where like numerals of reference designate like elements throughout it will be noted that the hat 100 shown in FIG. 1 is a hat of typical baseball cap-like construction having a bowl, crown, or cap portion 102 to which a bill, brim or visor 104 is attached. The bill 104 extends out generally horizontally from the base of the bowl 102 and serves as a shade for the eyes of a wearer (not shown) of the cap 100.

Circumscribing the bill 104 is piping 110. The piping generally circumscribes the exterior perimeter of the bill 104 along its upper edge or top. FIG. 2 shows an enlarged view of a portion of the piping shown in FIG. 1. As indicated in FIG. 2, the piping 110 may carry a logo 112 or the like in order to provide additional enhancements to the piping 110. The piping 110 may be flush with the edge of the bill 114 or may be slightly offset from it as shown in FIG. 2.

FIG. 3 shows an exploded view of the bill portion of the hat 100. The bill 104 has a top cloth cover 120 and a bottom cloth cover 122. The top and bottom cloth covers 120, 122 are cut in form fitting fashion so that they fit closely with the stiffener 130 and serve to provide an attractive cloth cover of any desired color or texture that may complement or offset the color, texture, and fabric of the bowl 102. The piping 110 is generally trapped or held between the top cloth cover 120 and the stiffener 130 in a fashion such that the piping 100 does not move with respect to the bill 104. Other means of attaching or embedding the piping 110 to the bill 104 may also be used. Such fixing of the piping 100 is shown in cross section in FIGS. 4–6 in alternative embodiments. These views correspond to a view taken along line 4—4 in FIG. 2.

Especially in conjunction with the piping 110 shown in FIG. 3, FIG. 4 shows that the piping 110 has an inwardly extending base 140 which at its forward end terminates in an upward projection 142. The piping base 140 forms a foundation for the engagement of the piping 100 by the bill 104 through one or more of the top cloth cover 120, the stiffener 130, or the bottom cloth cover 122. Although not shown in FIG. 4, the stiffener 130 may be present in the bill 104 as part of the bottom cloth cover 122, may be offset from the piping 110 so as not to be present in FIG. 4, or may be absent entirely from the bill 104.

In FIG. 4, the top cloth cover 120 is shown adhesively attached to a top portion of the base 140 with the forward section and top projection 142 with the piping 110 left exposed and visible. The bottom cloth cover 122 is likewise adhesively attached by an adhesive 150 to the bottom of the base 140 and the piping 110. The same or a similar adhesive 150 may be used to attach the top cloth cover to the top of the base 140.

When the piping 100 is so engaged by the top cloth cover 120 and the bottom cloth cover 122 as shown in FIG. 4, the stiffener 130 may be inserted into the envelope created by the attachment of the top and bottom cloth covers 120, 122 by the piping 110. The stiffener 130 and the top and bottom cloth covers 120, 122 establish the bill 104 and are then attached to the bowl 102 with stitching or the like in a fashion that generally exerts some tension on the stiffener 130. The stiffener 130 may have the additional feature of holding the top and bottom cloth covers 120, 122 in place as well as the piping 110.

Figure 5:
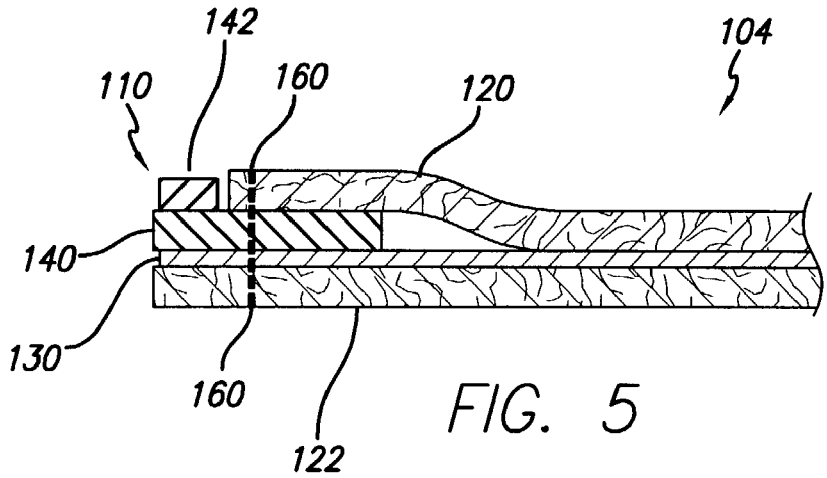
FIG. 5 is an alternative embodiment of the cross section shown in FIG. 4.

Alternatively, as is shown in FIG. 5, stitching 160 may be used to attach the top and bottom cloth covers 120, 122 as well as the stiffener 130 to the piping 110 in a manner similar to that shown in FIG. 4 which leaves the top projection 142 of the piping 110 as well as the front of the piping 110 exposed and visible.

Figure 6:
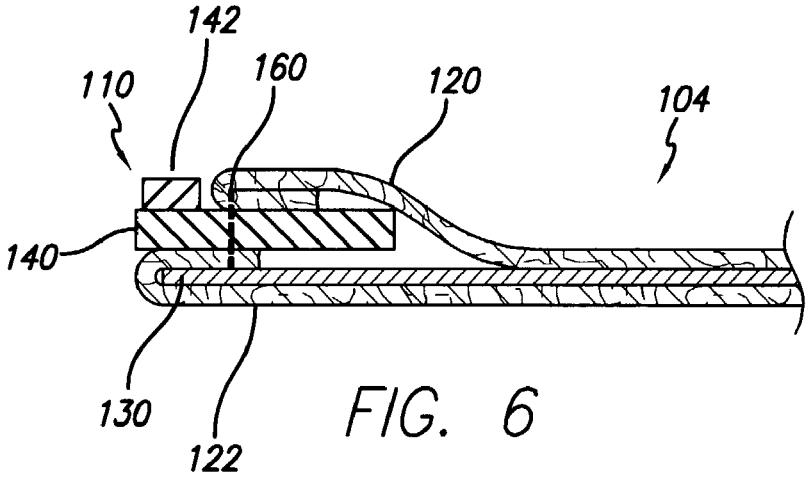
FIG. 6 is another alternative embodiment of the cross section shown in FIG. 4.

Alternatively, FIG. 6 portrays an additional embodiment where the top cloth cover 120 and bottom cloth cover 122 can be independently or coordinatingly stitched to the piping 110. When so independently stitched to the piping 110, the top and bottom cloth covers can be so attached in a manner where the cloth covers 120, 122 are folded back upon themselves so as to form a generally narrow doubled-back layer on either side of the piping 110.

Initially, the cloth covers 120, 122 are stitchedly attached near one edge to opposite sides of the piping 110. The major portion of the cloth covers 120, 122 then temporarily extend over and past the upward projection 142. In such a situation, the base 140 of the piping 110 with its rearward projection could be, for the temporary purposes of describing this attachment, considered to be the forward portion of the piping 110. A margin of fabric for both the top and bottom cloth covers 120, 122 is then provided there which is forward of the stitching that attaches the top and bottom cloth covers 120, 122 to the piping 110. This leaves a cloth envelope with the top projection 142 of the piping 110 covered by the inside of such a cloth envelope. This cloth envelope is then turned inside out so that the fabric doubles back upon the previously-forward margin and the stiffener 130 may be inserted into this envelope beneath the base 140 so as to provide the bill 104 shown in FIG. 1.

Other means may also be used by which the piping 110 may be attached either directly to the stiffener 130, the top cloth cover 120, the bottom cloth cover 122 or any combination thereof.

One advantage to using rubber or the like with a logo 112 is that the piping 110 actually provides a convenient means by which to keep a grip on the cap 100 by engaging its bill 104. The base 140 of the piping 110 is then present underneath the top cloth cover 120 and is tactilely discernible when grasping the edge of the brim 104. The exposed projection 142 or other area of the piping 110 also provides means that enhance the grip and engagability of the hat 100. This is particularly true when a logo 112 is present along the projection 142 as it provides additional means by which a grip can be better established and maintained on the bill 104.

As indicated above, the piping 110 can be made of a variety of different substances and materials including plastic, leather, and the like. Generally, the piping 110 is a prefabricated strip of such material and the logo 112 may be deposited by the careful application of melted rubber or the like, stitching (as in the case of leather) or otherwise, generally prior to the incorporation of the piping 110 into the bill 104.

Where melted rubber is deposited as on a plastic or rubber piping strip 110, it may be immediately cooled with cooling gas and there after formed into the bill edge as indicated above. The resulting piping 110 with indicia 112 may thereafter be formed onto or into the bill edge in order to provide the piping set forth herein. Other series of steps may be used such as adding the indicia after the piping 110 is coupled to the bill 104. However, it is currently contemplated that such addition of indicia 112 after attachment of the piping 110 to the bill 104 may present problems during manufacture. The piping 110 and any logo 112 may be the same or different colors depending upon the preferences of the manufacturer or consumer.

Beyond the additional gripping enhancements that the piping provides to the hat 100, any logo 112 may serve to enhance the attractiveness or appeal of the cap as by adding the name of a popular celebrity, products (for hats used as advertisements), sayings or quotations, designs, or any other printed matter that fits sufficiently on the projection 142 of the piping 110.

While the present invention has been described with regards to particular embodiments, it is recognized that additional variations of the present invention may be devised without departing from the inventive concept.

What is claimed is:

1. A cap with a bill, comprising:

embossed piping, said piping coupled to said bill, said piping also being partially exposed and visible, a flat base portion extending rearwardly and coupled to said bill; and an upwardly projecting portion coupled to and projecting away from said flat base portion, said upwardly projecting portion being at least partially visible from outside said cap.

2. A cap with a bill as set forth in claim 1, said piping further comprising:

embossed indicia, said indicia coupled to said upwardly projecting portion whereby said indicia is visible from outside said cap.

3. A baseball cap with a bill, comprising:

embossed piping, said piping coupled to said bill, said piping also being partially exposed and visible, said piping having a flat base portion extending rearwardly and coupled to said bill and said piping having an upwardly projecting portion coupled to and projecting away from said flat base portion, said upwardly projecting portion being at least partially visible from outside said cap;

embossed indicia, said indicia coupled to said upwardly projecting portion whereby said indicia is visible from outside said cap;

a top cover coupled to a top side of said piping;

a bottom cover coupled to a bottom side of said piping; and a stiffener held between said top and bottom covers.

4. A baseball cap with a bill as set forth in claim 3, said bill further comprising:

said top and bottom covers coupled to said piping selected from the group consisting of:

said top and bottom covers adhesively attached to said piping;

said top and bottom covers stitchedly attached to said piping; and said top and bottom covers stitchedly attached to said piping then doubled back to protect exposed edges of said top and bottom covers, said stiffener held between a marginal portion of said bottom cover stitched to said piping and a major portion of said bottom cover at an outside edge of said stiffener.

5. A method for decorating a cap, the steps comprising:

providing a crown;

providing a bill for attachment to said crown;

attaching piping to said bill, said piping coupled to said bill, said piping also being partially exposed and visible;

embossing said piping;

wherein said piping comprises a flat base portion extending rearwardly and coupled to said bill; and an upwardly projecting portion coupled to and projecting away from said flat base portion, said upwardly projecting portion being at least partially visible from outside said cap.

6. A method for decorating a cap as set forth in claim 5, wherein said piping further comprises:

embossed indicia, said indicia coupled to said upwardly projecting portion whereby said indicia is visible from outside said cap.

7. A method for decorating a cap as set forth in claim 5, the steps further comprising:

applying embossed indicia to said piping by laying on melted material on said piping, said melted material in form of said indicia; and cooling said melted material to set said indicia.

8. A method for decorating a cap as set forth in claim 5, the steps further comprising:

coupling a top cover to a top side of said piping;

coupling a bottom cover to a bottom side of said piping; and providing a stiffener between said top and bottom covers;

wherein the steps of coupling said top and bottom covers to said piping are selected from the group consisting of:

adhesively attaching said top and bottom covers to said piping;

stitchedly attaching said top and bottom covers to said piping; and stitchedly attaching said top and bottom covers to said piping, doubling back said top and bottom covers to protect exposed edges of said top and bottom covers, and holding said stiffener between a marginal portion of said bottom cover stitched to said piping and a major portion of said bottom cover at an outside edge of said stiffener.

9. A method for decorating a cap, the steps comprising:

providing a baseball cap crown;

providing a baseball cap bill for attachment to said crown; and attaching embossable piping to said bill, said piping coupled to said bill, said piping also being partially exposed and visible, said piping having a flat base portion extending rearwardly and coupled to said bill and said piping having an upwardly projecting portion coupled to and projecting away from said flat base portion, said upwardly projecting portion being at least partially visible from outside said cap;

applying embossed indicia to said piping by laying on melted material on said piping, said melted material in form of said indicia;

cooling said melted material to set said indicia;

coupling a top cover to a top side of said piping;

coupling a bottom cover to a bottom side of said piping; and providing a stiffener between said top and bottom covers.

10. A method for decorating a cap as set forth in claim 9, wherein the steps of coupling said top and bottom covers to said piping are selected from the group consisting of:

adhesively attaching said top and bottom covers to said piping;

stitchedly attaching said top and bottom covers to said piping; and stitchedly attaching said top and bottom covers to said piping, doubling back said top and bottom covers to protect exposed edges of said top and bottom covers, and holding said stiffener between a marginal portion of said bottom cover stitched to said piping and a major portion of said bottom cover at an outside edge of said stiffener.

11. A cap prepared in accordance with claim 9.

12. A bill for a cap, comprising:

embossed piping, said piping coupled to said bill, said piping also being partially exposed and visible;

said piping comprising:

a flat base portion extending rearwardly and coupled to said bill; and an upwardly projecting portion coupled to and projecting away from said flat base portion, said upwardly projecting portion being at least partially visible from outside said bill.

13. A bill for a cap as set forth in claim 12, said piping further comprising:

embossed indicia, said indicia coupled to said upwardly projecting portion whereby said indicia is visible from outside said bill.

14. A baseball cap-type bill for a cap, comprising:

embossed piping, said piping coupled to said bill, said piping also being partially exposed and visible, said piping having a flat base portion extending rearwardly and coupled to said bill and said piping having an upwardly projecting portion coupled to and projecting away from said flat base portion, said upwardly projecting portion being at least partially visible from outside said bill;

embossed indicia, said indicia coupled to said upwardly projecting portion whereby said indicia is visible from outside said bill;

a top cover coupled to a top side of said piping;

a bottom cover coupled to a bottom side of said piping; and a stiffener held between said top and bottom covers.

15. A baseball cap-type bill for a cap, comprising:

embossed piping, said piping coupled to said bill, said piping also being partially exposed and visible, said piping having a flat base portion extending rearwardly and coupled to said bill and said piping having an upwardly projecting portion coupled to and projecting away from said flat base portion, said upwardly projecting portion being at least partially visible from outside said bill;

embossed indicia, said indicia coupled to said upwardly projecting portion whereby said indicia is visible from outside said bill;

a top cover coupled to a top side of said piping;

a bottom cover coupled to a bottom side of said piping; and a stiffener held between said top and bottom covers;

said top and bottom covers coupled to said piping selected from the group consisting of:

said top and bottom covers adhesively attached to said piping;

said top and bottom covers stitchedly attached to said piping; and said top and bottom covers stitchedly attached to said piping then doubled back to protect exposed edges of said top and bottom covers, said stiffener held between a marginal portion of said bottom cover stitched to said piping and a major portion of said bottom cover at an outside edge of said stiffener.

16. A method for decorating a bill of a cap, the steps comprising:

providing a bill for attachment to a crown of a cap; and attaching embossed piping to said bill, said piping coupled to said bill, said piping also being partially exposed and visible; wherein said piping comprises:

a flat base portion extending rearwardly and coupled to said bill; and an upwardly projecting portion coupled to and projecting away from said flat base portion, said upwardly projecting portion being at least partially visible from outside said bill.

17. A method for decorating a bill of a cap as set forth in claim 16, wherein said piping further comprises:

embossed indicia, said indicia coupled to said upwardly projecting portion whereby said indicia is visible from outside said bill.

18. A method for decorating a bill of a cap as set forth in claim 16, the steps further comprising:

applying embossed indicia to said piping by laying on melted material on said piping, said melted material in form of said indicia; and cooling said melted material to set said indicia.

19. A method for decorating a bill of a cap, the steps comprising:

providing a baseball cap bill for attachment to a baseball cap crown; and attaching embossable piping to said bill, said piping coupled to said bill, said piping also being partially exposed and visible, said piping having a flat base portion extending rearwardly and coupled to said bill and said piping having an upwardly projecting portion coupled to and projecting away from said flat base portion, said upwardly projecting portion being at least partially visible from outside said bill;

applying embossed indicia to said piping by depositing melted material on said piping, said melted material in form of said indicia;

cooling said melted material to set said indicia;

coupling a top cover to a top side of said piping;

coupling a bottom cover to a bottom side of said piping; and providing a stiffener between said top and bottom covers.

20. A method for decorating a bill of a cap as set forth in claim 19, wherein the steps of coupling said top and bottom covers to said piping are selected from the group consisting of:

adhesively attaching said top and bottom covers to said piping;

stitchedly attaching said top and bottom covers to said piping; and stitchedly attaching said top and bottom covers to said piping, doubling back said top and bottom covers to protect exposed edges of said top and bottom covers, and holding said stiffener between a marginal portion of said bottom cover stitched to said piping and a major portion of said bottom cover at an outside edge of said stiffener.

21. A cap prepared in accordance with claim 19.

* * * * *